US009518555B2

(12) United States Patent
Bokatius et al.

(10) Patent No.: US 9,518,555 B2
(45) Date of Patent: Dec. 13, 2016

(54) RADIATION DEVICES

(71) Applicants: Mario M. Bokatius, Chandler, AZ (US); Lakshminarayan Viswanathan, Phoenix, AZ (US); David P. Lester, Phoenix, AZ (US); Basim H. Noori, Gilbert, AZ (US); Pierre Marie J. Piel, Chandler, AZ (US)

(72) Inventors: Mario M. Bokatius, Chandler, AZ (US); Lakshminarayan Viswanathan, Phoenix, AZ (US); David P. Lester, Phoenix, AZ (US); Basim H. Noori, Gilbert, AZ (US); Pierre Marie J. Piel, Chandler, AZ (US)

(73) Assignee: FREESCALE SEMICONDUCTOR, INC., Austin, TX (US)

( * ) Notice: Subject to any disclaimer, the term of this patent is extended or adjusted under 35 U.S.C. 154(b) by 252 days.

(21) Appl. No.: 14/560,675

(22) Filed: Dec. 4, 2014

(65) Prior Publication Data

US 2016/0160833 A1 Jun. 9, 2016

(51) Int. Cl.

| | |
|---|---|
| ***H01T 13/16*** | (2006.01) |
| ***F02P 23/04*** | (2006.01) |
| ***H05H 1/24*** | (2006.01) |
| ***H01T 21/02*** | (2006.01) |
| ***H05H 1/52*** | (2006.01) |

(52) U.S. Cl.

CPC ..... *F02P 23/04* (2013.01); *H01T 13/16* (2013.01); *H01T 21/02* (2013.01); *H05H 1/24* (2013.01); *H05H 1/52* (2013.01)

(58) Field of Classification Search

CPC ..... F02P 23/04; H01T 13/16; H01T 21/02; H05H 1/24; H05H 1/52

See application file for complete search history.

(56) References Cited

U.S. PATENT DOCUMENTS

| | | | | |
|---|---|---|---|---|
| 4,388,549 | A * | 6/1983 | Bensman | H01T 13/467 313/138 |
| 5,361,737 | A | 11/1994 | Smith et al. | |
| 6,114,811 | A | 9/2000 | Wu | |
| 7,741,761 | B2 * | 6/2010 | Jaffrezic | H01T 13/52 313/141 |
| 7,928,642 | B2 * | 4/2011 | Malek | H01T 13/52 313/118 |

(Continued)

OTHER PUBLICATIONS

McIntyre, Dustin, L. Thesis: The Coaxial Cavity Resonator as a Prototype RF IC Engine Ignition Source West Virginia University, Department of Mechanical and Aeorspace Engineering.

(Continued)

*Primary Examiner* — Hieu T Vo

(57) ABSTRACT

A radiation device and related method are presented. The radiation device includes a body. The body includes a threaded portion configured to engage with a threaded opening in an engine and an open interior volume. The radiation device includes a ground electrode coupled to the body, a substrate disposed within the open interior volume in the body, and a radio frequency generator on the substrate. The radio frequency generator is configured to receive an input signal and, in response to the input signal, generate plasma energy between the body and the ground electrode.

20 Claims, 5 Drawing Sheets

(56) References Cited

U.S. PATENT DOCUMENTS

| | | | | |
|---|---|---|---|---|
| 8,547,020 | B2 * | 10/2013 | Barroso | F02P 9/007 315/111.21 |
| 8,646,129 | B1 * | 2/2014 | Chen | A47D 9/02 5/101 |
| 2003/0042131 | A1 | 3/2003 | Johnson | |
| 2015/0152833 | A1 | 6/2015 | Mongin et al. | |
| 2016/0160833 | A1 | 6/2016 | Bokatius et al. | |

OTHER PUBLICATIONS

Notice of Allowance mailed Aug. 23, 2016 for U.S. Appl. No. 14/293,741 11 pages.

* cited by examiner

RADIATION DEVICES

TECHNICAL FIELD

Embodiments of the subject matter described herein relate generally to radiation devices and, more particularly, to radiation devices usable in conjunction with radio frequency (RF) plasma ignition systems.

BACKGROUND

A typical internal combustion engine for a motor vehicle includes multiple cylinders, their associated pistons, a crankshaft, a fuel delivery and exhaust system (including a camshaft and associated valves), and an ignition system, the combination of which makes up the primary torque generation subsystem for the vehicle. When a piston is properly engaged within a cylinder, a combustion chamber is defined by the top of the piston, the cylinder sidewalls, and a cylinder head sitting atop the cylinder. During operation of the engine, the volume of the combustion chamber is varied by moving the piston linearly within the cylinder. It is the variation in the combustion chamber volume which, ultimately, may be translated into torque for propelling the vehicle.

More specifically, in both a two-stroke and a four-stroke engine, the volume of the combustion chamber is decreased and increased, respectively, during a compression stroke and a power stroke of the piston. Prior to the compression stroke (i.e., during an intake stroke), rotation of the camshaft causes a fuel intake valve to open, which allows atomized fuel to be injected into the chamber to produce a fuel/air mixture within the chamber. During the compression stroke, the piston is pushed toward the cylinder head (or toward a "top dead center" position), which compresses the fuel/air mixture, thus increasing the mixture's thermal energy. At or near the time that the piston reaches the top dead center position, a sparkplug produces a spark within the combustion chamber. The spark ignites the compressed fuel/air mixture, causing it to combust and expand. The force of expansion initiates the piston's power stroke, forcing the piston rapidly away from the cylinder head. During a subsequent exhaust stroke, the camshaft rotation causes an exhaust valve to open, thus allowing the gasses within the combustion chamber (e.g., the exhaust gasses) to exit the cylinder.

Each piston has a connecting rod coupled to the crankshaft, and during the power stroke, the connecting rod exerts a strong linear force on the crankshaft, which converts the linear force into a rotational force. In order to maintain the crankshaft rotation, the combustions within the multiple chambers are timed so that the linear forces exerted on the crankshaft by each piston are out of phase with each other. More specifically, a distributor of the ignition system is used to route high voltage from an ignition coil to each sparkplug in a carefully timed and correct firing order. The torque associated with the crankshaft's rotational force ultimately can be translated into axle and wheel rotation, thus enabling propulsion of the vehicle.

In practice, the above-described combustion process is not 100% efficient. For example, during each combustion cycle, a certain amount of unburned fuel remains in the combustion chamber after each power stroke, and the unburned fuel is exhausted to the atmosphere during the exhaust stroke. The quantity of fuel that remains unburned during a combustion cycle affects the vehicle's fuel efficiency. Thus, engine developers seek to improve ignition systems to increase the percentage of fuel within each chamber that is burned during each combustion cycle.

In addition, combustion of the fuel/air mixture results in the production of a variety of gasses, which are exhausted from the vehicle through the vehicle's exhaust system. For example, in a typical petroleum-fueled engine, exhaust gasses include nitrogen oxides ($NO_x$), carbon dioxide ($CO_2$), and carbon monoxide (CO), among other things. Some of the exhaust gasses may be harmful to humans and to the environment when they are present in sufficient quantities. Accordingly, engine developers also seek to modify fuels and ignition systems in order to reduce the quantity of potentially-harmful gasses that are exhausted into the environment.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the inventive subject matter include radiation devices for plasma ignition systems and associated RF power amplification and distribution systems. As will be explained in more detail below, the radiation device enables the delivery of plasma energy by a plasma ignition system into a cylinder of an engine.

Similar to an ignition system of a conventional internal combustion engine, a plasma ignition system functions to combust gaseous fuel in a combustion chamber defined by a piston and cylinder arrangement. However, in a plasma ignition system, the combustion is at least partially achieved by discharging high-energy plasma into the combustion chamber, rather than producing a relatively low energy spark within the combustion chamber or in combination therewith. The high-energy plasma discharge can more reliably and efficiently start the process of burning fuel than a conventional spark. In addition, the plasma discharge may be produced in a combustion chamber having significantly higher pressures than would be possible for a conventional spark. Accordingly, a plasma ignition system may enable higher power operation than a conventional ignition system.

Figure 1:
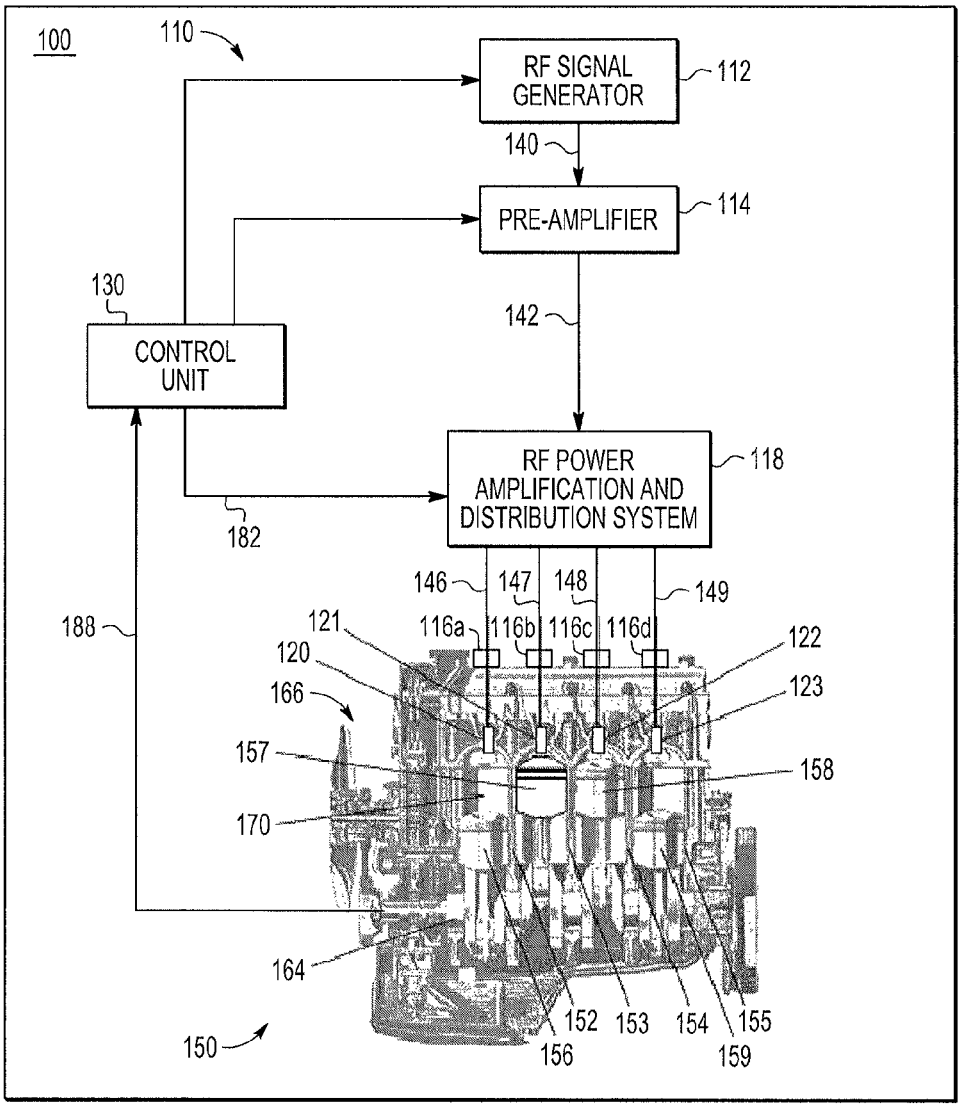
FIG. 1 is a block diagram of a plasma ignition system for a four cylinder engine, in accordance with an example embodiment.

FIG. 1 is a simplified block diagram of a torque generation system 100 that includes a plasma ignition system 110 and an internal combustion engine 150, in accordance with an example embodiment. For example, the torque generation system 100 may be incorporated into a motor vehicle, and the torque generation system 100 may function as the primary source of torque used to propel the vehicle. In other embodiments, however, internal combustion engine 150 may be incorporated into a generator, machinery, or other equipment.

Internal combustion engine 150 is similar to a conventional internal combustion engine in that engine 150 includes multiple cylinders 152-155, their associated pistons 156-159 and connecting rods, a crankshaft 164, and a fuel delivery and exhaust system 166 that includes a camshaft (not numbered) configured to operate fuel intake and exhaust valves (not numbered). As with a conventional internal combustion engine, a chamber 170 is defined by each piston/cylinder pair in internal combustion engine 150, and the volume of the chamber 170 is decreased and increased, respectively, during a compression stroke and a power stroke of the piston. In contrast with a conventional internal combustion engine, however, in the internal combustion engine 150 of FIG. 1, a radiation device 120-123 of the plasma ignition system 110 produces a high energy plasma discharge in the chamber 170 at or near the time that the piston reaches the top dead center position (e.g., the position of piston 157 in cylinder 153). The plasma discharge ignites a compressed fuel/air mixture within the chamber 170, causing the fuel to combust and expand. The force of expansion initiates the piston's power stroke, forcing the piston 156-159 rapidly away from the cylinder head. The piston's connecting rod exerts a strong linear force on the crankshaft 164, which converts the linear force into a rotational force or torque. The torque associated with the crankshaft's rotational force ultimately can be translated into axle and wheel rotation, thus enabling propulsion of a vehicle within which system 100 is incorporated.

Also similar to operation of a conventional internal combustion engine, in order to maintain the rotation of crankshaft 164, the combustions within the multiple chambers 170 of internal combustion engine 150 are timed so that the linear forces exerted on the crankshaft 164 by each piston 156-159 and connecting rod are out of phase with each other (e.g., about 90 degrees out of phase with each other in a four-cylinder, four-stroke engine).

Plasma ignition system 110 is configured to provide high power RF energy to each radiation device 120-123 in order to produce a plasma discharge in each chamber 170. More specifically, plasma ignition system 110 is configured so that the high power RF energy provided to the radiation devices 120-123 is timed to achieve out of phase, timed plasma discharges within the chambers 170, and thus to cause continuous crankshaft rotation. To produce the timed plasma discharges, plasma ignition system 110 includes RF signal generator 112, pre-amplifier 114, RF power amplification and distribution system 118, and radiation devices 120-123.

RF signal generator 112 is configured to produce an RF signal 140. For example, the RF signal 140 may include periodic pulses of RF power, where each pulse is produced at or near the beginning of a power stroke for each cylinder 152-155. The duration of each pulse may be shorter than the duration of each power stroke. For example, the duration of each pulse may be from about 10 percent to about 50 percent of the duration of each power stroke, and each pulse may be timed to arrive at a cylinder at a beginning of each power stroke. The RF power in RF signal 140 may be produced at a frequency in a range of about 1.0 megahertz (MHz) to about 6.0 gigahertz (GHz) (e.g., about 2.4 GHz) according to various embodiments. In other embodiments, the frequency of the RF power may be higher or lower than the above given range. In various embodiments, there may be a single large pulse per ignition cycle or many smaller pulses per ignition cycle (e.g., 1 ms continuous pulse per ignition cycle or 500 1 microsecond pulses spaced 1 second apart per ignition cycle).

The output of RF signal generator 112 is coupled to the input of pre-amplifier 114. Pre-amplifier 114 may be a single stage amplifier or a multiple-stage amplifier, in various embodiments. Essentially, pre-amplifier 114 receives and amplifies the RF signal 140 produced by RF signal generator 112, in order to produce an amplified RF signal 142 having a power level that is sufficient to enable generation of a plasma discharge by radiation devices 120-123. For example, the RF signal 140 produced by RF signal generator 112 may have a power level in the milliwatt (mW) range, and pre-amplifier 114 may amplify the RF signal 140 to produce an output RF signal 142. For example, depending upon the amount of gain applied by pre-amplifier 114, pre-amplifier 114 may produce an RF signal 142 having a power level from the mW range (e.g., as low as 1.0 mW) up to a power level of hundreds or thousands of watts (W) (e.g., up to or exceeding about 2.0 kilowatts (kW)), in an embodiment. In alternate embodiments, the power levels of the RF signals 140, 142 produced by the RF signal generator 112 and/or the pre-amplifier 114 may be higher or lower than the above given ranges. In an alternate embodiment, pre-amplifier 114 may be excluded from the plasma ignition system 110.

In an embodiment that includes pre-amplifier 114, the output of pre-amplifier 114 is coupled to the input of RF power amplification and distribution system 118. Alternatively, in an embodiment that does not include pre-amplifier 114, the output of RF signal generator 112 is coupled to the input of RF power amplification and distribution system 118. Either way, RF power amplification and distribution system 118 is configured to receive an RF signal (either RF signal 140 or 142) produced by RF signal generator 112 or pre-amplifier 114, and to distribute the RF signal to the radiation devices 120-123 associated with the various piston/cylinder pairs. More specifically, RF power amplification and distribution system 118 is configured to provide multiple pulsed RF signals 146-149 to the radiation devices 120-123. According to an embodiment, the RF power amplification and distribution system 118 provides a pulsed RF signal 146-149 to each radiation device 120-123 at an appropriate time for timing the ignition process. According to a further embodiment, only one RF signal 146-149 of significant power is provided at any given time by the RF power amplification and distribution system 118 to the radiation devices 120-123.

Directional couplers **116*a*-116*d* are configured to detect the forward and reflected power of the RF signals provided to the radiation devices 120-123, and to produce signals that are transmitted to control unit 130 that indicate the detected forward and reflected power levels. According to an embodiment in which closed-loop control is implemented, control unit 130 receives the power level signals from each directional coupler 116*a*-116*d*, and based on the signals and pre-determined timing algorithms, provides control signals 182 to RF power amplification and distribution system 118. In other open-loop configurations, directional couplers 116***a*-116*d* may not be incorporated into torque generation system 100 and instead control unit 130 may receive a trigger input (e.g., via a feedback signal 188 from crankshaft 164), which indicates to control unit 130 the correct timing of the pulsed RF signals 146-149 that are to be provided by the RF power amplification and distribution system 118 to the radiation devices 120-123, and control unit 130 may provide control signals 182 to RF power amplification and distribution system 118 accordingly.

The radiation devices (e.g., radiation devices 120-123 of FIG. 1) may, in various embodiments, have a similar form factor to that of a conventional spark plug. With such a form factor, the radiation devices can be installed into a conventional engine in place of conventional spark plugs. Once installed, the radiation devices may then be configured to create plasma radiation energy arranged to trigger combustion within a corresponding engine cylinder. In some embodiments, the radiation devices can be configured to couple to the vehicle's conventional ignition system and to manipulate the conventional direct current (DC) voltage generated by such a system to create the plasma energy. The manipulation may involve converting the DC voltage into a high-frequency RF signal and amplifying the signal. Alternatively, the radiation devices may be configured to receive a separate input from an ignition system configured to generate RF signals, such as the system illustrated in FIG. 1, and to generate the plasma energy using that separate input.

Once generated, the plasma energy can be delivered by the radiation device into the corresponding engine cylinder. This may involve delivering the plasma energy through a central conductor of the radiation device to a ground electrode of the radiation device. As described in further detail below, in various embodiments, the central conductor and ground electrode of the radiation devices may be constructed in a similar fashion to the corresponding structures in a conventional spark plug.

Figure 2A:
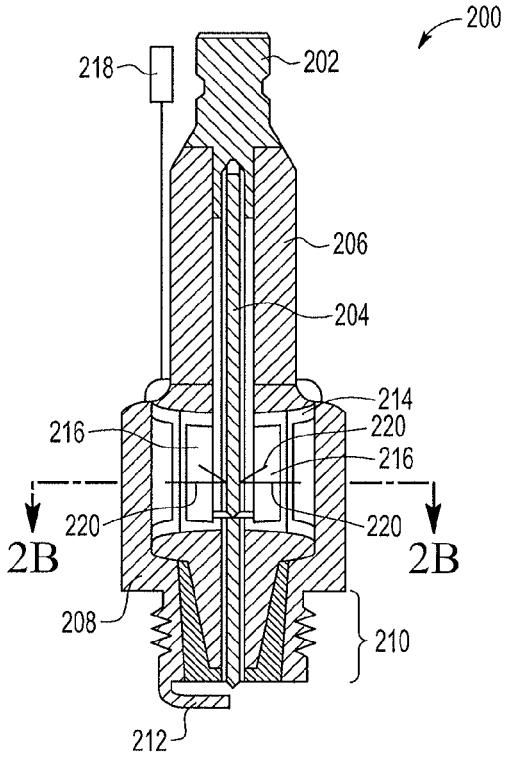
FIGS. 2A and 2B are cross-sectional views of a radiation device configured in accordance with the present disclosure.
Figure 2B:
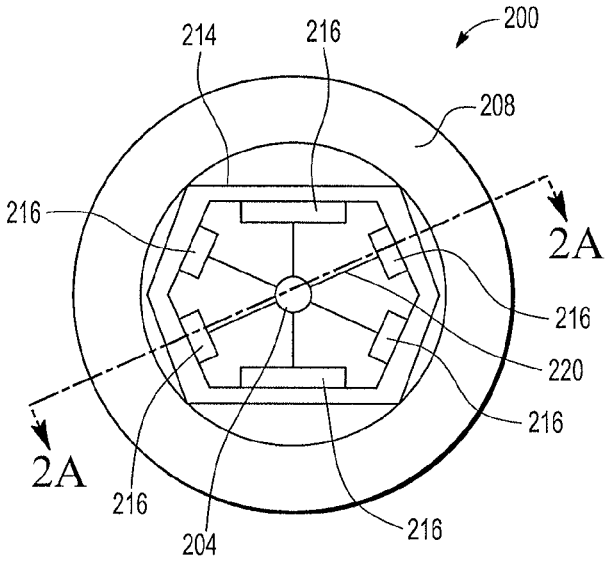

FIGS. 2A and 2B are cross-sectional views of a radiation device 200 configured in accordance with the present disclosure. FIG. 2A shows a cross-sectional view of radiation device 200 taken vertically through the device along line 2A-2A of FIG. 2B. FIG. 2B shows a cross-sectional view of radiation device 200 taken horizontally through the device along line 2B-2B of FIG. 2A. As illustrated, radiation device 200 may have a similar form factor to that of a conventional spark plug, enabling radiation device 200 to be installed into a cylinder of a conventional engine.

Radiation device 200 includes terminal 202. Terminal 202 may be configured to couple to a conventional spark plug cable connecting terminal 202 to a conventional ignition coil. Alternatively, terminal 202 may be configured to couple to a plasma ignition system. Terminal 202 is connected to center electrode 204, which is a conductive structure that runs along a length of radiation device 200.

Center electrode 204 runs through insulator 206. In various embodiments, insulator 206 may be constructed of ceramic, plastic, or another electrically insulative material. Insulator 206 is connected to body 208. Body 208 generally includes a conductive material forming a metal case or jacket for radiation device 200. Body 208 is formed with threads 210 enabling body 208, and thereby radiation device 200, to be screwed into a threaded opening formed into an engine cylinder. Because body 208 is conductive, radiation device 200, once installed into the engine, can be grounded to the engine. Body 208 includes a conductive extension forming ground electrode 212.

An open interior volume is formed within body 208. Substrate 214 is mounted into the open interior volume of body 208. A number of RF generators 216 are mounted to a surface of substrate 214. Each RF generator 216 may include a single chip or die, as is shown in FIGS. 2A and 2B, or may comprise a number of distinct components, such as oscillators, amplifiers, and impedance matching components, that are electrically coupled to one another.

RF generators 216 may be configured to receive an input signal and generate a corresponding RF output signal. The signal inputted to RF generators 216 may be a DC input signal, such as a DC control signal transmitted by a plasma ignition system, or the DC signal generated by a conventional ignition system. In that case, RF generators 216 may be configured to translate that DC input signal into a suitably configured RF output signal. Alternatively, the signal inputted to each RF generator 216 may be an RF signal that is ultimately amplified by the RF generators 216. As such, RF generators 216 may comprise RF generators, RF amplifiers, or any other devices or systems configured to output RF signals depending upon the attributes of the input signal received by the RF generators 216.

The signal inputted into each RF generator 216 may be received through terminal 202 of radiation device (e.g., from a connected ignition cable). In other embodiments, however, radiation device 200 may include a separate input configured to receive a signal that is transmitted to RF generators 216. For example, FIG. 2 shows input 218 that is connected to RF generators 216 and may be utilized to receive an input signal different from that received by terminal 202 and which is ultimately communicated to RF generators 216. The connection between input 218 and RF generators 216 may be routed along an outside of radiation device 200, or may be formed through insulator 206 and reside at least partially within the interior volume of body 208.

RF generators 216 are connected to center electrode 204 by connections 220 enabling RF generators 216 to communicate RF energy into center electrode 204. That RF energy then manifests as plasma energy at the junction between the tip of center electrode 204 and ground electrode 212. The plasma energy can then be used, in turn, to ignite or further the ignition of an air-fuel mixture present within a cylinder of an engine.

Connections 220 may be formed by any number of wire bonds or any other conductive structure or structures formed between center electrode 204 and RF generators 216. Connections 220 may be formed as a wire connecting RF generators 216 and center electrode 204 or may be formed as any other suitable structure, such as one or more ribbons of conductive material. Connections 220 may be formed as flexible structure, or may be relatively stiff and may be formed on an optional substrate.

During operation of radiation device 200, RF generators 216 may be controlled by a signal received at input 218. The input signal may be a DC control signal, or an RF input signal. The input signal is received by RF generators 216 and in response the RF generators 216 generate RF output signals that are communicated into center electrode 204.

At the same time, a relatively high voltage DC signal may be received at terminal 202. The high voltage DC signal may be, in some embodiments, a conventional spark plug signal. The high voltage DC signal, once supplied to terminal 202, can then generate a conventional spark between center electrode 204 and ground electrode 212. This spark can then be used a seed spark to facilitate the generation of the plasma energy between center electrode 204 and ground electrode 212 in response to the RF signal outputted by RF generators 216 or as a back-up spark in the event that the plasma generation system fails.

In other embodiments, however, where input 218 is not included, RF generators 216 can be configured to receive an input signal at terminal 202 and convert that input signal to an RF output signal suitable for the generation of plasma energy. In that case, center electrode 204 may not be continuous throughout radiation device 200 and may instead be formed as two separate electrically isolated parts. The first part of center electrode 204 could then be connected to terminal 202 and to inputs of the RF generators 216 to supply the input signal thereto. The second part of center electrode 204 could then be connected to outputs of the RF generators 216 with an end of the second part of center electrode 204 being positioned sufficiently close to ground electrode 212 to form a terminal between which plasma energy can be formed.

The RF generators 216 and substrate 214 may be positioned at any suitable location within radiation device 200. FIGS. 2A and 2B show RF generators 216 positioned within an internal volume of body 208, but in other embodiments, RF generators 216 and substrate 214 may be positioned within insulator 206. Generally, because RF generators 216 are directly connected to center electrode 204 and are in relative proximity to center electrode 204 as compared to an RF generator that may be located outside radiation device 200, the RF generators 216 can deliver energy into center electrode 204 in a more efficient manner than an external RF generator.

As illustrated in FIGS. 2A and 2B, to facilitate their installation into the interior of radiation device 200, RF generators 216 and substrate 214 are wrapped about an interior volume of radiation device 200. In one embodiment, this can be achieved by mounting RF generators 216 to a flexible substrate 214 that can then be folded into a suitable shape for installation into radiation device 200. Flexible substrate 214 may include a relatively solid structure configured to fold at predetermined locations enabling substrate 214 to be installed within radiation device 200. Alternatively, substrate 214 may be a curved substrate structure (e.g., in the shape of a cylinder) that includes one or more localized flat regions enabling mounting of RF generators 216 thereon. In other cases, substrate 214 may have curved inner and outer surfaces, and RF generators 216 are connected to substrate 214 via solder bumps or other structures enabling RF generators 216 to couple to one of the curved surfaces of such a substrate 214.

Figure 3A:
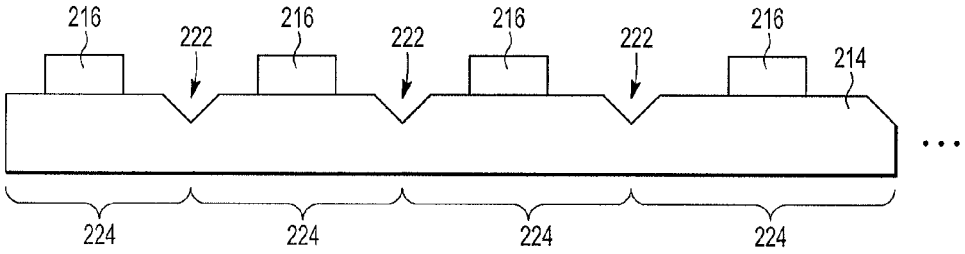
FIGS. 3A and 3B are side views of embodiments of a flexible substrate that can be incorporated into a radiation device.
Figure 3B:
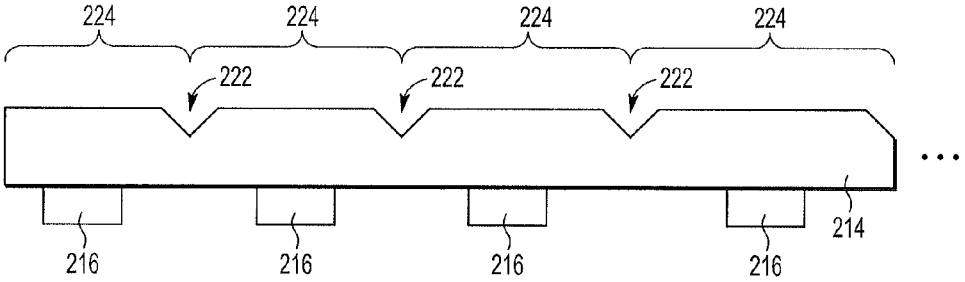

To illustrate, FIGS. 3A and 3B are side views of embodiments of flexible substrate 214 that can be incorporated into radiation device 200. Substrate 214 may include a structure or die carrier over which one or more electrical components, such as RF generators 216, can be mounted and interconnected. As shown in FIGS. 3A and 3B, the components may be mounted over a front and/or a back surface of substrate 214, respectively. In various embodiments, substrate 214 may include a printed circuit board (PCB), flexible PCB, ceramic, or any other substrate material or combination of materials. Substrate 214 may include a number of flexible circuits with multiple layers of dielectrics and metals (Cu, Al, etc). The metal layers can be patterned to provide appropriate circuits. An example of substrate 214 includes a liquid crystal polymer (LCP) based flexible circuit.

Because substrate 214 is flexible, substrate 214 can be folded into a shape suitable for installation into radiation device 200. To facilitate the folding of substrate 214, a number of notches 222 may be formed in one or more surfaces of substrate 214. By folding substrate 214 along each notch 222, substrate 214 can be folded into a shape that allows substrate 214 to be installed into radiation device 200.

The notches 222 formed in substrate 214 define a number of panels 224 of substrate 214. Because substrate 214 is folded at notches 222, panels 224 are generally planar and provide suitable structures over which components, such as RF generators 216, can be mounted.

Figure 4:
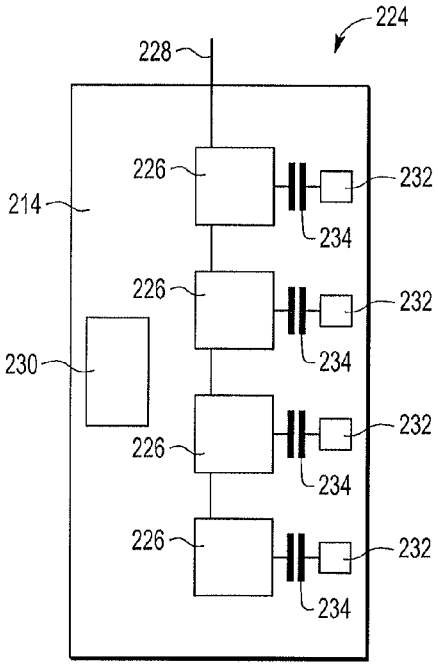
FIG. 4 shows an example panel of a substrate that can be incorporated into a radiation device.

FIG. 4 shows an example panel 224 of substrate 214. A number of active components 226 are formed over substrate 214. Active components 226 could include one or more of RF generators, amplifiers, RF matching circuits, and the like. The active components 226 are connected to one another and receive an input signal via input 228. The active components 226 are configured to either convert the input signal into an RF output signal, or be controlled by the input signal to generate such an RF output signal. Input 228 may be coupled, for example, to input 218 or terminal 202 shown in FIG. 2A. During their operation, active components 226 may utilize one or more additional circuits or components that are also mounted to substrate 214, such as oscillator 230.

The outputs of active components 226 are connected to contact pads 232 which are, in turn, connected to an electrode of the radiation device (see, for example, center electrode 204 in FIGS. 2A and 2B). Because the electrode may carry a substantial DC voltage—this is particularly the case if the electrode is carrying a DC voltage sufficiently high to create a conventional spark—DC filters 234 may be disposed between the active components 226 and contact pads 232. DC filters 234 are configured to allow the RF output signal generated by the active components 226 to pass to contact pads 232, while blocking DC voltage from passing from contact pads 232 to active components 226. As such, DC filters 234 can protect (e.g., DC isolate) the active components 226 from high voltages that may be present at contact pads 232 connected to the center electrode 204 of radiation device 200.

Figure 5:
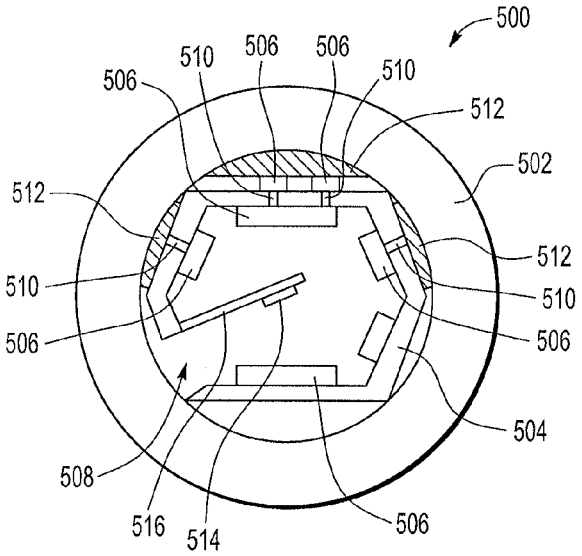
FIG. 5 is a cross-sectional view of an alternative embodiment of a radiation device configured in accordance with the present disclosure.

FIG. 5 is a cross-sectional view of an alternative embodiment of a radiation device configured in accordance with the present disclosure. The view of radiation device 500 illustrated in FIG. 5 is taken along a similar plane of a radiation device to that illustrated by line 2B-2B shown in FIG. 2A.

Radiation device 500 includes a body or insulator 502 defining an open interior volume or space. Substrate 504 is disposed within the opening formed in body or insulator 502. Substrate 504 is shaped to fit within the opening of body or insulator 502 and, in one embodiment, includes a substrate that has been folded to fit within the opening, as is described above with respect to FIGS. 3A and 3B. Substrate 504 may include a printed circuit board (PCB), flexible PCB, ceramic, or any other substrate material or combination of materials.

A number of devices 506 are mounted to a surface of substrate 504 and are interconnected to one another. The interconnections may be formed by vias running along a surface of or internal to substrate 504 or via wire bond connections or other electronic couplings. Devices 506 may include RF generators, amplifiers, oscillators, impedance matching circuits, and the like.

In some embodiments, a portion of substrate 504 may be removed to form an opening to facilitate the installation of devices 506, or any other components or structures within radiation device 500. For example, opening 508 of substrate 504 may facilitate access to the interior of substrate 504 when substrate 504 is positioned within radiation device 500 providing access to an interior region of substrate 504 and facilitating the installation of components therein.

Substrate 504 may include a number of conductive slugs or through-hole vias 510. In some cases, vias 510 may be utilized to provide an electrical connection and/or thermal connection between one surface of substrate 504 and a second surface of substrate 504. This could enable devices 506 mounted on opposing surfaces of substrate 504 to be placed in electrical communication with one another. In some embodiments, devices 506 may be mounted to substrate 504 using a thermally conductive composite or contact pads to further facilitate heat transfer. Vias 510 may also be used to conduct heat away devices 506 mounted to the interior surface of substrate 504. To facilitate heat removal from devices 506, one or more heat sink structures 512 may be positioned about the interior region of body or insulator 502 and placed in thermal communication with one or more of vias 510 or devices 506 positioned on the outer surface of substrate 504.

Although substrate 504 may be utilized in conjunction with a center electrode such as that depicted in FIG. 2B, FIG. 5 shows an alternative configuration of center electrode 514. As illustrated in FIG. 5, center electrode 514 is configured as a conductive element mounted to a surface of a non-conductive support structure 516. Both center electrode 514 and support structure 516 may be shaped to run the length of radiation device 500 to replace a conventional center electrode structure entirely, or may couple to a conventional center electrode. Center electrode 514 may be fabricated by patterning copper as in PCB and direct bond copper on ceramic/dielectric (DBC) or direct plated Cu or ceramic/dielectric fabrication techniques. Another approach for fabricating center electrode 514 may involve printing thick film paste over a ceramic substrate. In that case, the paste can be Ag, Au, PtAg, AgPd etc. These pastes may include, in some cases, glass to improve adherence of the composite paste to the ceramic substrate. Alternatively, sintered silver paste can be also applied to the dielectrics to fabricate center electrode 514.

Support structure 516 generally includes any suitable structure over which center electrode 514 may be formed, such as a printed circuit board (PCB), flexible PCB, ceramic, or any other substrate material or combination of materials. In some embodiments, support structure 516 is formed as a separate structure that is mounted to substrate 504. In other embodiments, however, support structure 516 may instead be formed as part of substrate 504 and may even be folded or otherwise bent to position center electrode 514 in a central region of the opening in body or insulator 502.

Figure 6A:
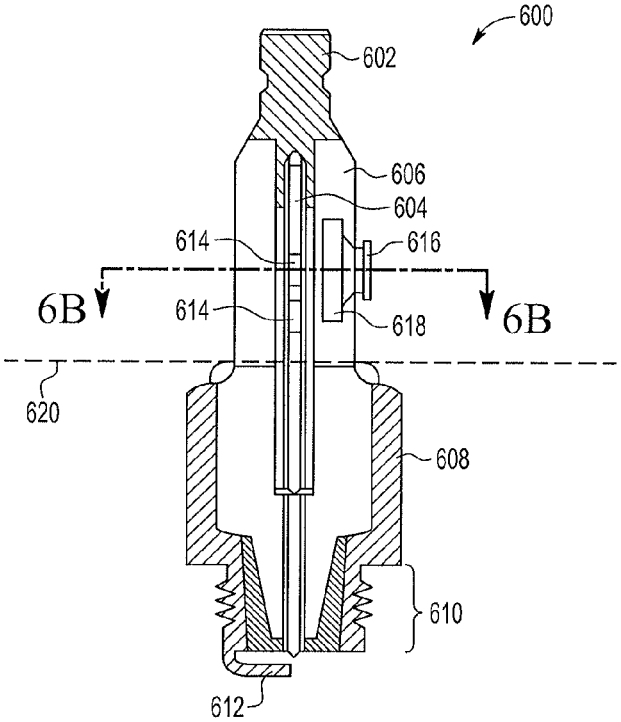
FIGS. 6A and 6B are cross-sectional views of a radiation device having a side-mounted RF signal input.
Figure 6B:
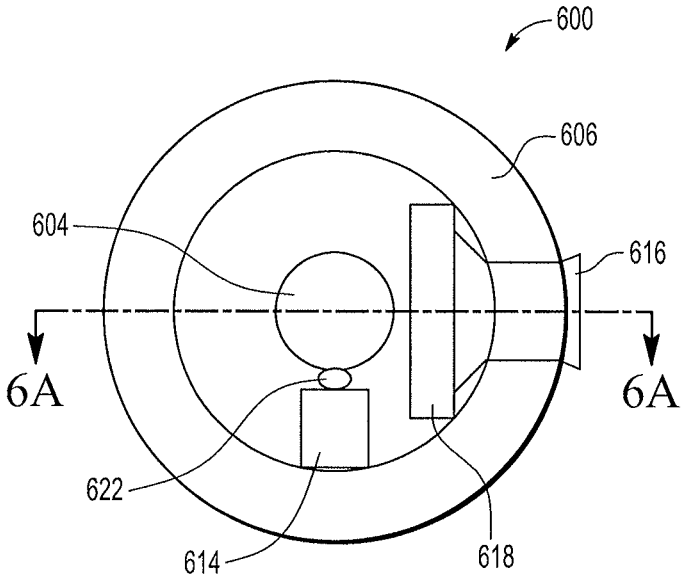

FIG. 6A is an illustration of an alternative embodiment of radiation device 600 having a side-mounted RF signal input. FIG. 6A shows a cross sectional view taken vertically through the device along line 6A-6A of FIG. 6B. FIG. 6B shows a cross-sectional view of radiation device 600 taken horizontally through the device along line 6B-6B of FIG. 6A. As illustrated, radiation device 600 may have a similar form factor to that of a conventional spark plug, enabling radiation device 600 to be installed into a conventional engine.

Radiation device 600 includes terminal 602. Terminal 602 may be configured to couple to a conventional spark plug cable connecting terminal 602 to a conventional ignition coil. Alternatively, terminal 602 may be configured to couple to a plasma ignition system. Terminal 602 is connected to center electrode 604, which is a conductive structure that runs along a length of radiation device 600.

Center electrode 604 runs through insulator 606. In various embodiments, insulator 606 may be constructed of ceramic, plastic, or another electrically insulative material. Insulator 606 is connected to body 608. Body 608 generally includes a conductive material forming a metal case or jacket for radiation device 600. Body 608 is formed with threads 610 enabling body 608, and thereby radiation device 600, to be screwed into a threaded opening formed into an engine cylinder. Because body 608 is conductive, radiation device 600, once installed into the engine, can be grounded to the engine. Body 608 includes a conductive extension forming ground electrode 612.

An open interior volume is formed within insulator 606, into which one or more components of radiation device 600 are installed. For example, a number of components 614, such as RF generators, amplifiers, oscillators, impedance matching circuits, and the like may be installed into radiation device 600 in any suitable manner. Components 614 may be flip-chip mounted directly to center electrode 604 via solder bumps 622, for example. Such an arrangement may be used, where the component 614 that is flip-chip mounted to center electrode 604 is configured to deliver an RF output signal into center electrode 604. That RF signal can then be carried by center electrode 604 to the junction between center electrode 604 and ground electrode 612 to generate plasma energy.

Alternatively, component 614 may be mounted to the interior wall of the open volume within insulator 606 and connected to center electrode 604 and/or one another via any other suitable electrical connection, such as wires, wire bonds, conductive ribbon, conductive traces formed over a substrate, and the like.

In some embodiments, radiation device 600 includes RF input 616 for receiving an input signal. The input signal may comprise an RF input signal that is sufficiently amplified to be delivered directly to center electrode 604 and generate plasma energy. In that case, RF input 616 may be coupled directly to center electrode 604.

In other embodiments, however, the signal inputted to RF input 616 may include a relatively low-energy RF signal requiring amplification before the signal is suitable for delivery into center electrode 604 for the generation of plasma energy. In that case, RF input 616 may be coupled to one or more components, such as component 618. In that case, component 618 is configured to receive the input from RF input 616, amplify the input signal, and then deliver the amplified signal to center electrode 604. Component 618 may be coupled to center electrode 604 by any suitable electrical connection, including physical connections (e.g., via wire, wire bond, or conductive ribbon), or non-physical connections (e.g., via electromagnetic coupling).

During operation, a DC voltage may be supplied to radiation device 600 at terminal 602. The DC voltage supplied to terminal 602 may be similar to that supplied to a conventional spark plug. The DC voltage supplied at terminal 602 can be sufficient to generate a spark between ground electrode 612 and center electrode 604. An RF signal may also be supplied to RF input 616, resulting in the generation of plasma energy between ground electrode 612 and center electrode 604. In one embodiment, the DC voltage can be supplied to terminal 602 at or about the same time as the RF signal is supplied to RF input 616. By supplying both inputs approximately at the same time the DC voltage (spark) can be used as a starter seed spark to facilitate the formation of the plasma energy. In that case, the DC voltage and RF signal may both be applied at the same time. Alternatively, RF signal may be applied first, with the plasma being generated once the DC voltage is applied at a later time. In another alternative, the DC voltage may be applied first with the RF signal being applied shortly thereafter to generate the plasma.

In radiation device 600, the components utilized to generate the RF signal that is inputted into center electrode 604 can be housed in body 608 of radiation device 600, rather than insulator 606. Because body 608 of radiation device 600 may be exposed to relatively high temperatures during operation and, consequently, the insulator 606 of radiation device 600 may be cooler than body 608, the components (e.g., 614 and 618) located in insulator 606 may be at least somewhat protected from the high temperatures of body 608, potentially resulting in increased operational life of those components.

Furthermore, in some embodiments, radiation device 600 may be separable into multiple components. For example, with reference to FIG. 6A, radiation device may be separable along the dashed line 620. As such, insulator 606 may be removably coupled to body 608 of radiation device 600. Any suitable coupling can be utilized. For example, insulator 606 and body 608 my screw into one another. In other embodiment, a number of fasteners can be used to join insulator 606 and body 608. Alternatively, the insulator 606 and body 608 may be simply held together once installed into an engine so that the insulator 606 and body 608 are not fixed to one another. As such, the insulator 606 portion of radiation device 600 and the body 608 of radiation device 600 may be installed as separate components into an engine.

By making insulator 606 and its components separable from body 608, it becomes possible to replace body 608 of radiation device 600 without discarding insulator 606 and its components. Because body 608 operates at higher temperatures and in a harsher environment than the remainder of radiation device 600, it may be likely that body 608 will fail before insulator 606 and its components. In fact, for some radiation devices 600, body 608 may require regular replacement. This may reduce the operating costs of radiation device 600 as the body 608 portion may be less expensive than the insulator 606 portion, which contains the components 614 and 618.

When separating insulator 606 from body 608, center electrode 604 may be retained in either insulator 606 or body 608, or may be separated into two distinct pieces, one piece being retained within insulator 606 and another piece being retained within body 608. In that case, when insulator 606 is coupled to body 608, the two pieces of center electrode would be electrically connected to one another.

In an embodiment, a radiation device includes a body. The body includes a threaded portion configured to engage with a threaded opening in an engine and an open interior volume. The radiation device includes a ground electrode coupled to the body, a substrate disposed within the open interior volume in the body, and a radio frequency generator on the substrate. The radio frequency generator is configured to receive an input signal and, in response to the input signal, generate plasma energy between the body and the ground electrode.

In another embodiment, a radiation device includes a body including a threaded portion configured to engage with a threaded opening in an engine, and a ground electrode coupled to the body. The radiation device includes a first input connected to the ground electrode. The first input is configured to receive a direct current voltage and, in response to the direct current voltage, generate a spark between the body and the ground electrode. The radiation device includes a second input configured to receive an input signal. The second input is configured to, in response to the input signal, generate a plasma energy between the body and the ground electrode.

In another embodiment, a method includes coupling a ground electrode to a body. The body includes a threaded portion configured to engage with a threaded opening in an engine. The method includes connecting a first input to the ground electrode. The first input is configured to receive a direct current voltage and, in response to the direct current voltage, generate a spark between the body and the ground electrode. The method includes connecting a second input to the ground electrode. The second input is configured to receive an input signal configured to generate a plasma energy between the body and the ground electrode.

In the various embodiments of radiation devices illustrated and described herein, the radiation devices have been described in a first polarity where an RF signal is supplied to a center electrode of the radiation device, and plasma energy is formed in the gap between the center electrode and an external ground electrode that is connected to a body of the radiation device. In other embodiments, however, that polarity can be reversed so that the RF input signal (and, optionally, a DC voltage) can be supplied to the body of the radiation device and a center electrode of the radiation device is instead grounded.

The terms "first," "second," "third," "fourth" and the like in the description and the claims are used for distinguishing between elements and not necessarily for describing a particular structural, sequential or chronological order. It is to be understood that the terms so used are interchangeable under appropriate circumstances. Furthermore, the terms "comprise," "include," "have" and any variations thereof, are intended to cover non-exclusive inclusions, such that a circuit, process, method, article, or apparatus that comprises a list of elements is not necessarily limited to those elements, but may include other elements not expressly listed or inherent to such circuit, process, method, article, or apparatus. The term "coupled," as used herein, is defined as directly or indirectly connected in an electrical or non-electrical manner.

While the principles of the inventive subject matter have been described above in connection with specific systems, apparatus, and methods, it is to be clearly understood that this description is made only by way of example and not as a limitation on the scope of the inventive subject matter. The various functions or processing blocks discussed herein and illustrated in the Figures may be implemented in hardware, firmware, software or any combination thereof. Further, the phraseology or terminology employed herein is for the purpose of description and not of limitation.

The foregoing description of specific embodiments reveals the general nature of the inventive subject matter sufficiently that others can, by applying current knowledge, readily modify and/or adapt it for various applications without departing from the general concept. Therefore, such adaptations and modifications are within the meaning and range of equivalents of the disclosed embodiments. The inventive subject matter embraces all such alternatives, modifications, equivalents, and variations as fall within the spirit and broad scope of the appended claims.

What is claimed is:

1. A radiation device, comprising:

a body, the body including a threaded portion configured to engage with a threaded opening in an engine and an open interior volume;

a ground electrode coupled to the body;

a substrate disposed within the open interior volume in the body; and a radio frequency generator on the substrate, the radio frequency generator being configured to receive an input signal and, in response to the input signal, generate plasma energy between the body and the ground electrode.

2. The radiation device of claim 1, including:

a center electrode; and wherein the radio frequency generator is coupled to the center electrode.

3. The radiation device of claim 2, wherein the radio frequency generator is coupled to the center electrode by a wire bond, a conductive ribbon, or a conductive trace.

4. The radiation device of claim 2, wherein the center electrode includes a conductive trace formed over a first portion of the substrate.

5. The radiation device of claim 4, wherein there radio frequency generator is on a second portion of the substrate and the first portion of the substrate and the second portion of the substrate are foldably connected.

6. The radiation device of claim 1, including a terminal configured to receive a direct current voltage.

7. The radiation device of claim 6, wherein the terminal is connected to the ground electrode and the direct current voltage is configured to generate a spark between the body and the ground electrode.

8. The radiation device of claim 6, wherein the terminal is direct current isolated from the radio frequency generator.

9. The radiation device of claim 1, including a heat sink disposed within the open interior volume in the body, and wherein the heat sink is thermally coupled to the radio frequency generator.

10. A radiation device, comprising:

a body including a threaded portion configured to engage with a threaded opening in an engine;

a ground electrode coupled to the body;

a first input connected to the ground electrode, the first input configured to receive a direct current voltage configured to generate a spark between the body and the ground electrode; and a second input configured to receive an input signal, the second input configured to, in response to the input signal, generate a plasma energy between the body and the ground electrode.

11. The radiation device of claim 10, including a radio frequency generator coupled to the second input and the ground electrode, the radio frequency generator configured to receive the input signal and generate an output radio frequency signal, the output radio frequency signal being configured to generate the plasma energy between the body and the ground electrode.

12. The radiation device of claim 11, wherein the input signal is a control signal configured to control an operation of the radio frequency generator.

13. The radiation device of claim 11, wherein the input signal is a radio frequency input signal and the radio frequency generator is configured to amplify the radio frequency input signal to generate the output radio frequency signal.

14. The radiation device of claim 11, including:

a center electrode; and wherein the radio frequency generator is coupled to the center electrode.

15. The radiation device of claim 14, wherein the radio frequency generator is coupled to the center electrode by a wire bond, a conductive ribbon, or a conductive trace.

16. The radiation device of claim 11, wherein the first input is direct current isolated from the radio frequency generator.

17. A method, comprising:

coupling a ground electrode to a body, the body including a threaded portion configured to engage with a threaded opening in an engine;

connecting a first input to the ground electrode, the first input configured to receive a direct current voltage and, in response to the direct current voltage, generate a spark between the body and the ground electrode; and connecting a second input to the ground electrode, the second input configured to receive an input signal configured to generate a plasma energy between the body and the ground electrode.

18. The method of claim 17, including connecting a radio frequency generator to the second input and the ground electrode, the radio frequency generator configured to receive the input signal and generate an output radio frequency signal, the output radio frequency signal being configured to generate the plasma energy between the body and the ground electrode.

19. The method of claim 18, including connecting the radio frequency generator to the center electrode using a wire bond, a conductive ribbon, or a conductive trace.

20. The method of claim 18, including:

mounting the radio frequency generator to a substrate; and disposing the substrate with an open interior volume of the body.

* * * * *